US008561363B2

(12) United States Patent
DeArmond, Jr.

(10) Patent No.: US 8,561,363 B2
(45) Date of Patent: Oct. 22, 2013

(54) APPARATUS AND METHOD FOR STABILIZING HEADSTONES

(76) Inventor: Thomas H. DeArmond, Jr., Hubbard, OR (US)

( * ) Notice: Subject to any disclaimer, the term of this patent is extended or adjusted under 35 U.S.C. 154(b) by 511 days.

(21) Appl. No.: 12/896,784

(22) Filed: Oct. 1, 2010

(65) Prior Publication Data

US 2012/0079777 A1 Apr. 5, 2012

(51) Int. Cl.
*E02D 27/42* (2006.01)

(52) U.S. Cl.
USPC ..... 52/170; 52/103; 52/298; 52/128; 47/29.5; 47/31

(58) Field of Classification Search
USPC ..... 52/103, 170, 297, 298, 38, 128, 660, 52/663; 47/29.5, 29.7, 31, 31.1, 32, 32.7, 47/33
See application file for complete search history.

(56) References Cited

U.S. PATENT DOCUMENTS

| | | | | | |
|---|---|---|---|---|---|
| 1,235,520 | A | * | 7/1917 | Kirfman | 47/32.4 |
| 1,951,132 | A | | 3/1934 | Cox | |
| 3,118,522 | A | | 1/1964 | Wetterlin | |
| 3,378,942 | A | | 4/1968 | Diamond | |
| 3,604,172 | A | | 9/1971 | Matvey | |
| 3,650,072 | A | | 3/1972 | Matvey | |
| 3,758,999 | A | | 9/1973 | Matvey | |
| 5,051,175 | A | * | 9/1991 | Walczak et al. | 210/166 |
| 5,437,127 | A | | 8/1995 | Ha | |
| 5,528,855 | A | * | 6/1996 | Kapphahn | 47/32 |
| 5,623,792 | A | | 4/1997 | Crumpacker | |
| 5,839,222 | A | * | 11/1998 | Sittner | 47/32 |
| 5,845,436 | A | | 12/1998 | Nota | |
| 5,953,859 | A | * | 9/1999 | Cochran et al. | 47/66.5 |
| 6,015,139 | A | * | 1/2000 | Weber | 256/65.14 |
| 6,199,327 | B1 | | 3/2001 | Krawczyk | |
| 6,266,921 | B1 | | 7/2001 | Keskilohko | |
| 6,526,693 | B2 | | 3/2003 | Cochran | |
| 7,144,201 | B2 | | 12/2006 | DeArmond, Jr. | |
| 7,617,631 | B2 | * | 11/2009 | Conrad et al. | 47/31.1 |
| 7,637,061 | B2 | | 12/2009 | Murphy et al. | |
| 2003/0154663 | A1 | | 8/2003 | Nelson | |
| 2005/0108932 | A1 | * | 5/2005 | Hsia | 47/32 |

* cited by examiner

*Primary Examiner* — Brian Glessner
*Assistant Examiner* — Brian D Mattei
(74) *Attorney, Agent, or Firm* — Law Office of William A. Birdwell

(57) ABSTRACT

An apparatus and method for stabilizing a headstone. A substantially-rigid perforated member is provided having a headstone aperture formed therein. The perforated member includes at least one anchor extending away from the perforated member to be driven into the ground. At least one securing member is disposed at the headstone aperture of the perforated member to secure the stabilizing apparatus to the headstone. The method includes providing such a perforated member, removing existing sod from around the headstone, placing the perforated member over the headstone with the headstone extending through the headstone aperture so that the perforated member is next to the ground, adjusting a securing member so as to secure the stabilizing apparatus to the headstone, and placing sod on top of the perforated member.

7 Claims, 4 Drawing Sheets

APPARATUS AND METHOD FOR STABILIZING HEADSTONES

BACKGROUND OF THE INVENTION

1. Field of the Invention

The present invention relates to cemetery equipment and maintenance and, in particular, to apparatuses and methods for stabilizing headstones in a cemetery.

2. Discussion of Related Art

It is the nature of a cemetery that people generally desire the memorial to those who have passed to be well maintained in dignity. However, vertical headstones can shift, sink and lift over time in a manner that detracts from the dignity and tranquility of a grave site. This is particularly so where the grave site is on a slope, as is often the case.

Various apparatuses and methods, such as those disclosed in Murphy et al. U.S. Pat. No. 7,636,061; Nota, U.S. Pat. No. 5,845,436; Crumpacker, U.S. Pat. No. 5,623,792; and DeArmond, U.S. Pat. No. 7,144,201 have been proposed to support or level a grave marker or headstone. However, all have various limitations with respect to stabilizing a vertical headstone.

Therefore, it would be desirable to have an apparatus and method that can be used to reorient and stabilize an existing vertical headstone, or to install with an original headstone to lengthen the period of time over which the headstone will remain upright.

SUMMARY OF THE INVENTION

The present invention provides a stabilizing apparatus for headstones. The apparatus comprises a substantially-rigid perforated member having a headstone aperture formed therein and an outer periphery. The perforations are preferably sufficiently large that roots of grass can grow there through. The aperture defines an inner periphery of predetermined size and shape so as to allow a headstone to fit there through. The apparatus also comprises at least one anchor preferably disposed at the outer periphery of the perforated member extending away from the perforated member substantially tangent to the outer periphery thereof. The apparatus further comprises at least one securing member disposed at the inner periphery of the perforated member adapted to exert force on a headstone extending through the headstone aperture to secure the stabilizing apparatus to the headstone.

The invention also provides a method for stabilizing a headstone. The method comprises providing a substantially-rigid perforated member having a headstone aperture formed therein shaped and sized to receive the headstone and an outer periphery, perforations in the perforated material being sufficiently large that roots of grass can grow there through, and at least one adjustable securing member disposed at the periphery of the headstone aperture to secure the stabilizing apparatus to the headstone by exerting force against the headstone. The method also comprises removing existing sod from around the headstone, placing the perforated member over the headstone with the headstone extending through the headstone aperture so that the perforated member is next to the ground, adjusting the securing member so as to secure the stabilizing apparatus to the headstone, and placing sod on top of the perforated member.

It is to be understood that this summary is provided as a means for generally determining what follows in the drawings and detailed description, and is not intended to limit the scope of the invention. Objects, features and advantages of the invention will be readily understood upon consideration of the following detailed description taken in conjunction with the accompanying drawings.

DETAILED DESCRIPTION OF THE PREFERRED EMBODIMENTS

Figure 1:
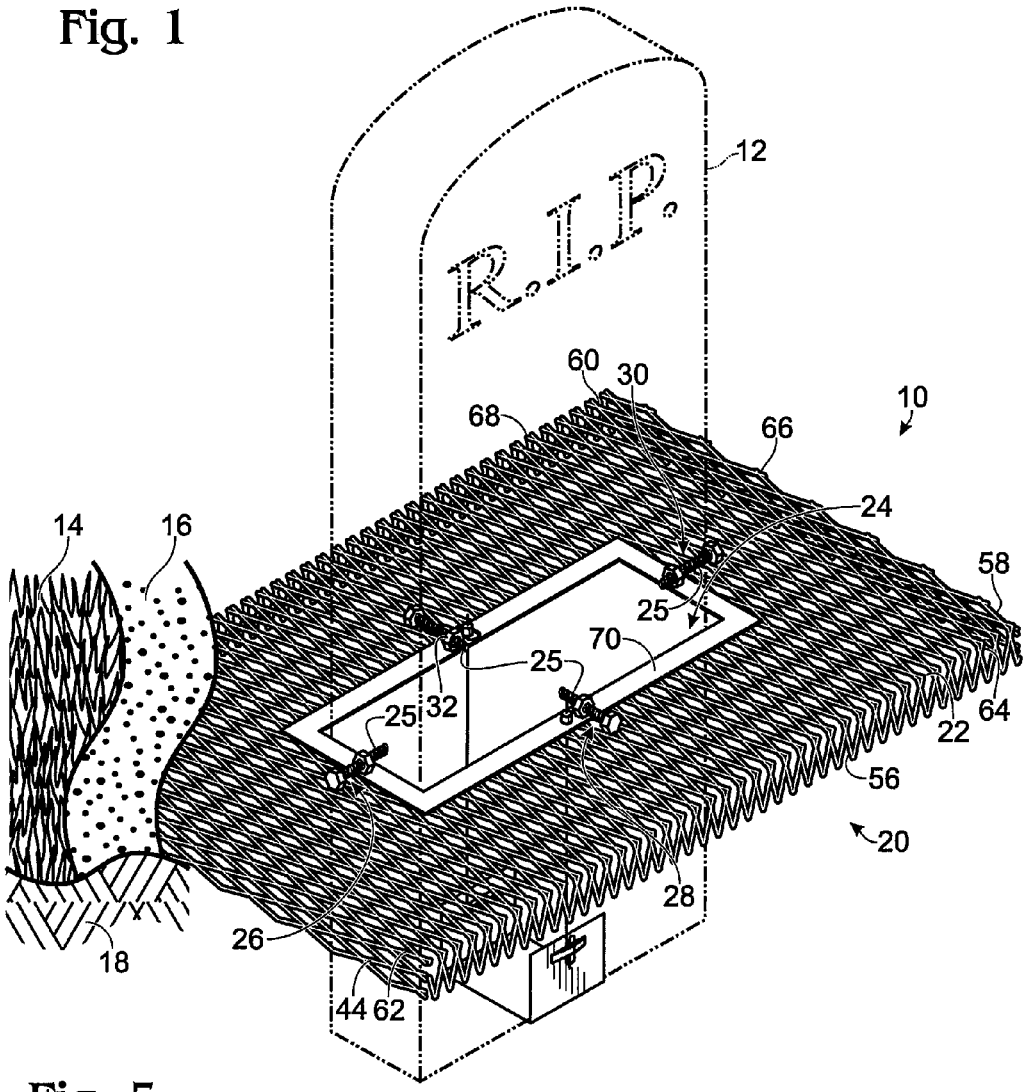
FIG. 1 is a perspective of a first preferred embodiment of a headstone stabilizing apparatus according to the present invention partially installed at a grave site, showing the headstone in phantom and the topsoil and turf cut away.

A headstone stabilizing apparatus according to the present invention is installed around the base of a headstone to stabilize the headstone to prevent tipping. The apparatus may be used with a newly-installed headstone, a removed and re-installed headstone, or a headstone that is already installed and not removed. FIG. 1 shows a preferred embodiment of a headstone stabilizing apparatus 10 according to the present invention partially around a headstone 12 with sod 14, topsoil 16 and ground 18 cut away to reveal the structure of the apparatus. Crushed limestone aggregate included in the installation, as described below with respect to FIGS. 8-13, is not shown in FIG. 1. The headstone stabilizing apparatus 10 includes an anchor portion 20 comprising a perforated member 22 having a headstone aperture 24 formed therein. The perforated member 22 is preferably a sheet of substantially rigid material, such as expanded metal or strong plastic. When installed, the perforated member 22 rests on top of the ground and the headstone 12 extends through the aperture 24. To that end, the aperture shape and size are selected so as to match the size and shape of the headstone 12 with which the apparatus is to be used. Securing members 26, 28, 30 and 32 are attached to the perforated member 22 at four locations around the inner periphery of the perforated member to exert opposing lateral forces on the headstone and thereby hold it in place. In the preferred embodiments the securing members comprise threaded bolts 24 inserted through respective threaded apertures of respective securing members 26, 28, 30 and 32, as will be more fully described below. Topsoil 16 is placed over the perforated member 22 and sod 14 is placed over the topsoil so as to extend its roots through the perforations. Thus the perforations in the perforated member should be sufficiently large that roots of grass can grow there through. It has been found that a perforated member made of expanded metal having fifty to sixty percent open area is particularly suitable for this purpose. This not only keeps the sod in place but also helps to keep the stabilizing apparatus and the headstone in place.

Figure 2:
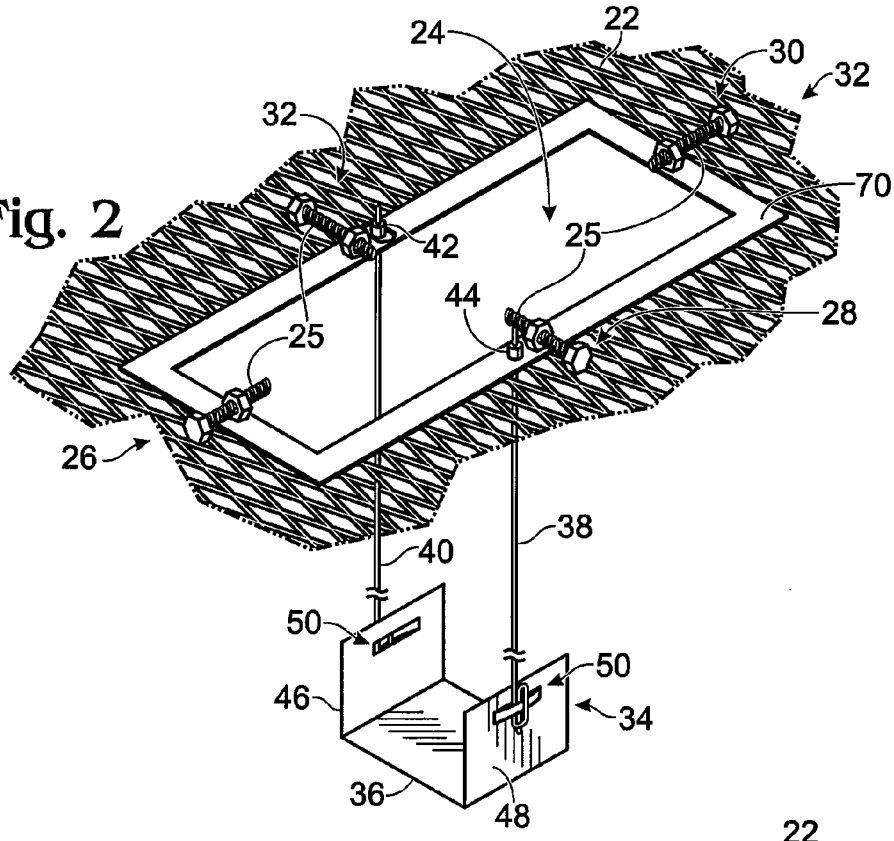
FIG. 2 is a perspective of an uninstalled first preferred embodiment of a headstone stabilizing apparatus according to the present invention.

Turning now to FIG. 2, a first preferred embodiment 32 of the stabilizing apparatus includes a bottom support member 34 to receive and support the bottom of the headstone 12. In this case, the bottom support member comprises a substantially-rigid bottom plate, made of, for example, metal or hard plastic. The plate preferably has a U-shaped cross section whose size is selected to accept the bottom of the headstone 12, which rests on a base portion 36 of the plate. The bottom plate is attached to the perforated member by two cables 38, 40 that extend between the bottom plate and the perforated member on opposite sides of the headstone when it is installed. At the top, the cables are attached to the perforated member by adjustable clamps 42, 44, such as commonly known "set collars." At the bottom, two sides 46, 48 of the bottom plate include a slotted portion 50 through which a cable is wrapped so as to crimp the cable to hold it in place. Once the headstone is properly positioned, the cables are clamped in place at the top as explained below.

Figure 3:
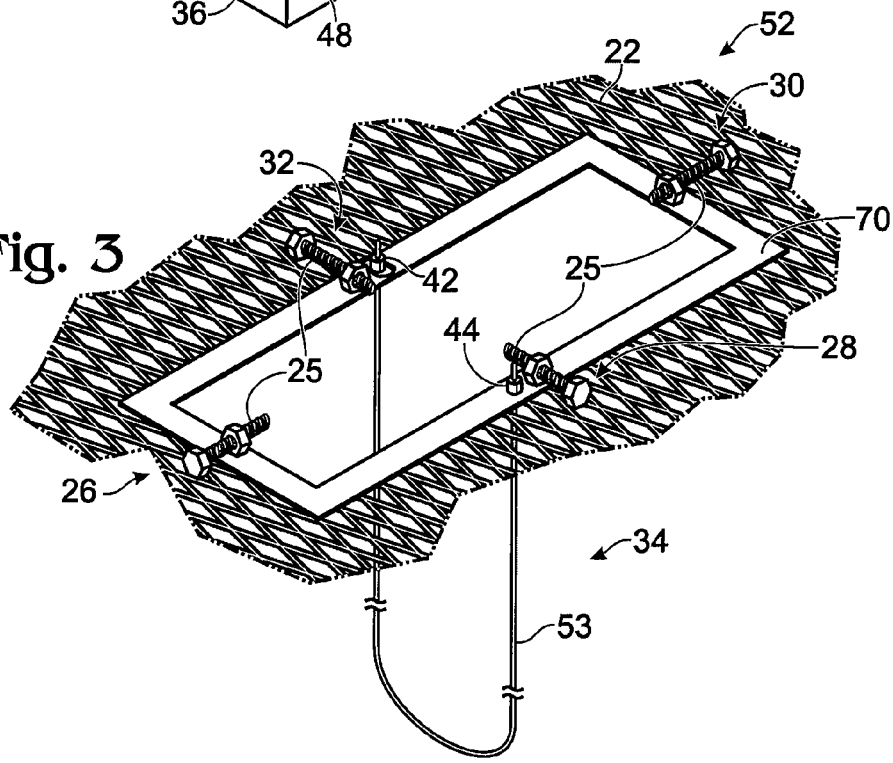
FIG. 3 is a perspective of an uninstalled second preferred embodiment of a headstone stabilizing apparatus according to the present invention.

In a second preferred embodiment 52, shown in FIG. 3, the bottom support member 30 comprises a single cable, or strap 52 that hangs down from its two ends fastened to the perforated member 22 with clamps 42, 44. In this case, the headstone rests on the cable or strap 52 itself In this embodiment the cable is adjusted by its two ends just as in the first preferred embodiment.

Returning to FIG. 1, preferably strips 54, 56, 58 and 60 of the perforated member at the outer periphery of the perforated member 22 are bent downwardly along respective sides of the perforated member so as to be substantially tangent to the respective outer edges 62, 64, 66 and 68 of the perforated member 22 formed by the bends. These downwardly bent portions form anchors which may be forced into the ground around the headstone when the stabilizing apparatus is installed. These anchors resist lateral movement of the perforated member once it is installed. It is to be recognized, however, that other structures could be formed in or attached to the perforated member so as to form anchors that penetrate the ground without departing from the principles of the invention.

The perforated member 22 includes a reinforcing member 70 disposed around the headstone aperture forming the inner periphery of the perforated member and attached thereto in a suitable manner, such as welding in the case of metallic material or gluing in the case of plastic material. In the embodiments of FIGS. 1, 2 and 3 each of the fixtures 26, 28, 30 and 32 is attached to the reinforcing member, for example by welding or gluing.

Figure 5:
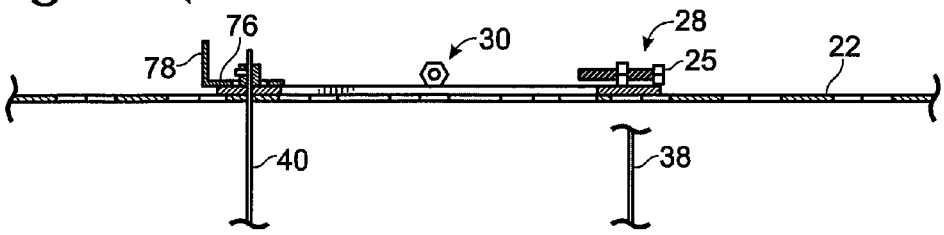
FIG. 5 is a cross section of the alternative anchor portion shown in FIG. 4, taken along line 5-5 of FIG. 4.
Figure 4:
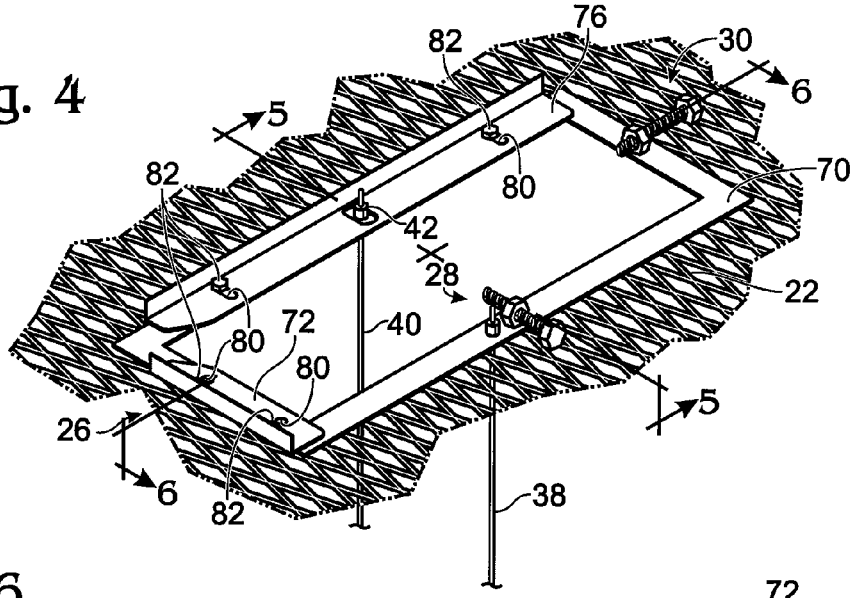
FIG. 4 is a perspective of an alternative embodiment of an anchor portion of a headstone stabilizing apparatus according to the present invention.
Figure 6:
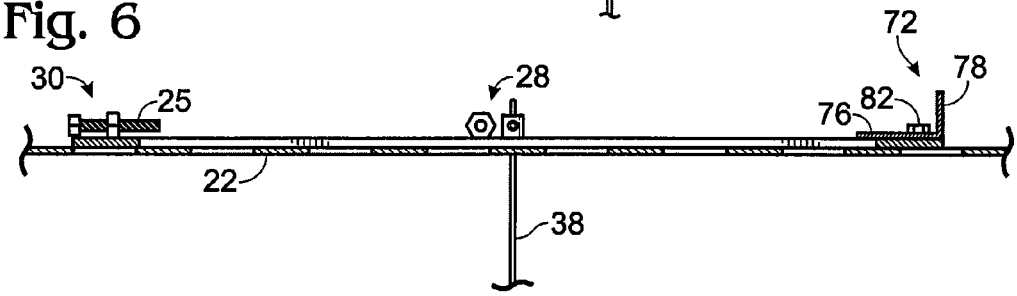
FIG. 6 is a cross section of the alternative anchor portion shown in FIG. 4, taken along line 6-6 of FIG. 4.
Figure 7:
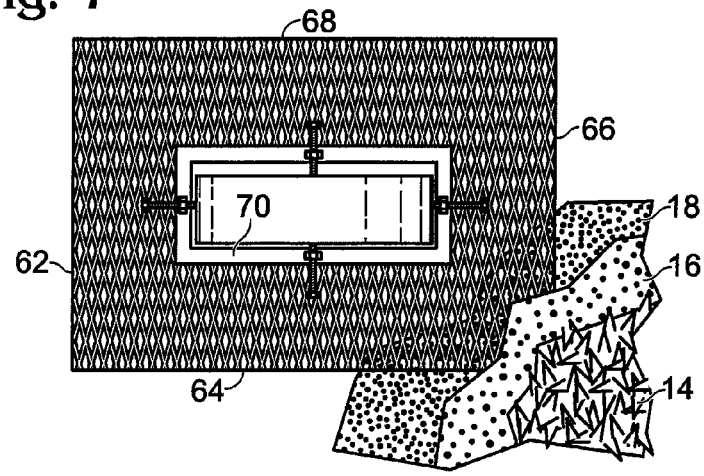
FIG. 7 is a top view of headstone stabilizing apparatus according to the present invention installed at a grave site, showing the turf, topsoil and ground cut away.

In an alternative embodiment of the anchor portion 20, only two fixtures 28 and 30, and corresponding bolts 24 disposed along substantially perpendicular sides are used. Instead of fixtures 24 and 32, sliding stops 72 and 74 are disposed on the sides opposite the fixtures 28 and 30. Stops 72 and 74 preferably have an L-shaped cross section, as shown in FIGS. 5 and 6, each comprising a base 76 and a lip 78, and include a plurality of elongated holes 80 formed therein, which receive bolts 82 threaded into apertures in the reinforcing member 70, so as to allow the position of the stops to be adjusted inwardly and outwardly to fix the headstone in place, and then be fastened securely by the bolts 82. FIGS. 4 and 5 also show by cross section the threaded engagement of bolts 24 with fixtures 28 and 30, respectively, as well as the set screw 84 in set collar 42. It is to be understood that, notwithstanding the disclosure of the afore described securing members herein, other structures that secure the perforated member to the headstone may be used without departing from the principles of the invention.

The process for installing the headstone stabilizing apparatus depends on the situation, that is, whether the headstone is part of a preexisting grave site and the condition of the headstone socket, or the headstone is to be installed in a new gravesite. Assuming that the headstone is either to be installed in a new grave site, or that it is part of an old grave site where the headstone socket is badly deteriorated, then the headstone will need to be installed into a new, properly prepared socket, or removed and re-installed into a refurbished old socket. In both of these situations, the method for stabilizing the headstone is as shown in FIGS. 8, 9, 10, 11, 12 and 13.

Figure 8:
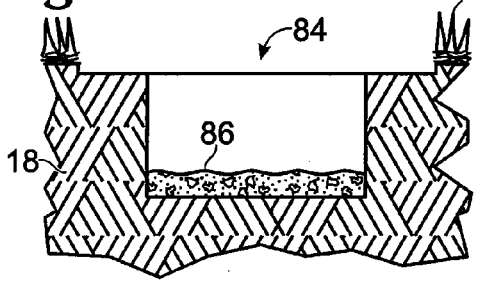
FIG. 8 is a cross section of a headstone socket prepared for insertion of a headstone according to the present invention.

Referring to FIG. 8, a headstone socket 84 is either originally prepared by removing sod, digging a hole of appropriate size and shape in the ground 18 and inserting moistened crushed limestone aggregate 86 at the bottom of the hole, or by removing sod and a headstone from its existing socket, cleaning the exposed hole, if necessary, and placing the limestone aggregate at the bottom. The limestone aggregate is preferably heavily tamped to full compaction at the bottom before proceeding further.

Figure 9:
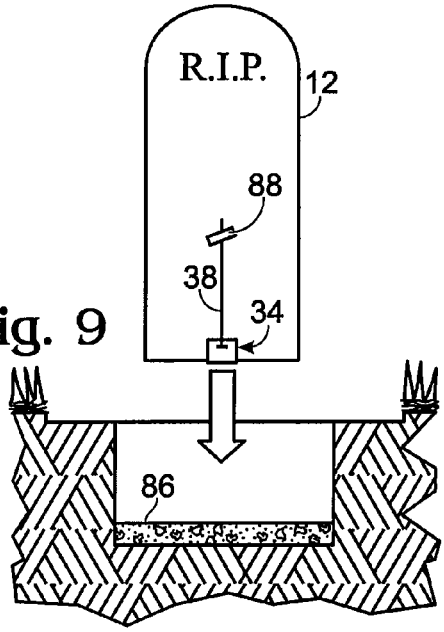
FIG. 9 is a cross section of a headstone socket showing the insertion of a headstone with a lower support portion of a headstone stabilizing apparatus attached according to the present invention.

Turning to FIG. 9, a headstone support member is placed under the bottom of a headstone 12 and the cables 38 and 40 (not shown) are preferably fixed to the sides of the headstone by tape 88. The headstone is then lowered into the headstone socket.

Figure 10:
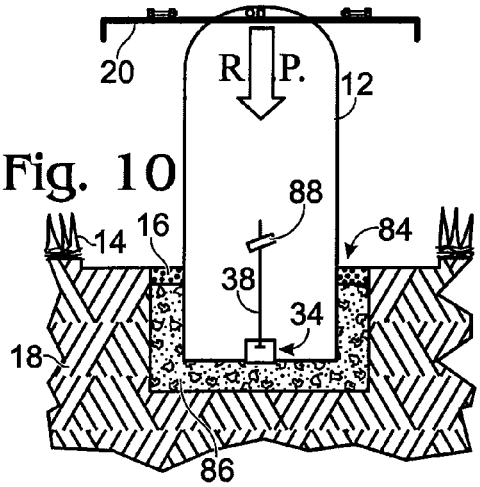
FIG. 10 is a cross section of a headstone socket showing a headstone in the socket, surrounded by limestone aggregate and an anchoring portion of a headstone stabilizing apparatus being put in place according to the present invention.

Once the headstone is lowered into the socket, as shown in FIG. 10, the tape is remove from the cables and additional moistened limestone aggregate 90 is placed around the sides. Preferably, this aggregate is also heavily tamped to full compaction before proceeding further. Also preferably, topsoil is placed on top of the limestone aggregate to bring the top level with the ground. Further, the entire excavation area is preferably watered and allowed to settle overnight, after which more topsoil is added to bring the top up to the ground level again.

Figure 11:
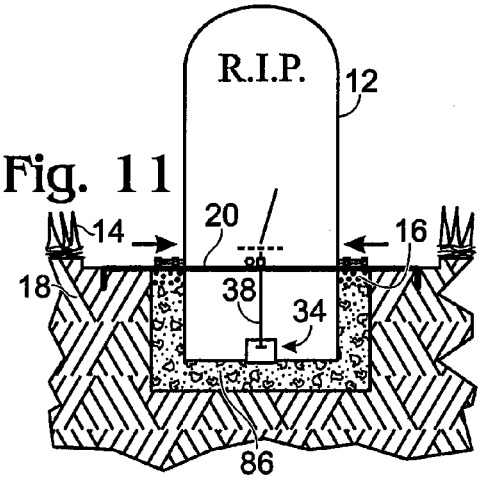
FIG. 11 is a cross section of a headstone socket showing the anchor portion of FIG. 10 in place and bottom support cables in place according to the present invention.

Next, an anchor member 20 is lowered over the headstone and down to ground level, as shown by FIGS. 10 and 11. Force is applied to the top of the perforated member to drive the anchors into the ground so that the perforated member 22 rests on the top of the ground and topsoil around the headstone.

Figure 12:
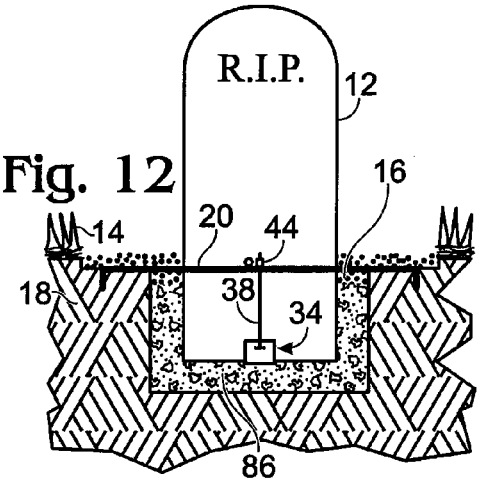
FIG. 12 is a cross section of a headstone socket showing topsoil placed over the anchor portion of FIG. 11 according to the present invention.

The headstone is positioned so as to stand up straight and securing members, that is, bolts 24, or bolts 25 and slides 72 and 76, are adjusted to hold the headstone in firmly place. Then the cables are drawn tight, the set screws in the set collars are tightened and excess cable is removed, as shown in FIG. 12. Preferably, stakes are also driven through the perforated member 20 into the ground to hold the perforated member in place until the sod grows through it.

Figure 13:
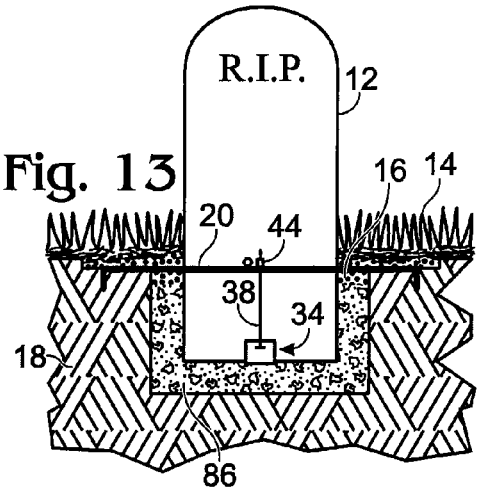
FIG. 13 is a cross section of a headstone socket showing a headstone as finally installed with sod placed over the topsoil in FIG. 12 according to the present invention.

Lastly, as shown by FIG. 13, additional top soil is placed on top of the perforated member 22 and sod is placed over the topsoil, thereby hiding the stabilizing apparatus and completing the installation.

In the case of an a headstone that is not to be removed for stabilization, the sod 14 and any existing topsoil 16 around it are removed, and the headstone 12 is manipulated to bring it straight. Then an anchor member 20 is placed over the headstone without the bottom support 30. Weight is applied to the anchor member to force the anchors into the ground, and the securing members are tightened to hold the headstone in place. Topsoil and turf are then placed over the anchor member to complete the stabilization apparatus installation.

The terms and expressions that have been employed in the foregoing specification are used therein as terms of description and not of limitation, and there is no intention, in the uses of such terms and expressions, to exclude equivalents of the features shown and described or portions thereof, it being recognized that the scope of the invention is defined and limited only by the claims which follow.

The invention claimed is:

1. A stabilizing apparatus for headstones, comprising:

a substantially-rigid perforated member having a headstone aperture formed therein and an outer periphery, the aperture defining an inner periphery of predetermined size and shape so as to allow a headstone to fit therethrough;

at least one anchor disposed at the outer periphery of the perforated member extending away from the perforated member substantially tangent to the outer periphery thereof;

at least one securing member disposed at the inner periphery of the perforated member adapted to exert force on a headstone extending through the headstone aperture to secure the stabilizing apparatus to the headstone, and a headstone bottom support flexibly attached to the perforated member at two locations at the inner periphery of the perforated member.

2. The stabilizing apparatus of claim 1, wherein the headstone bottom support comprises a substantially rigid plate attached to the perforated member by at least one flexible cable so as to provide support for a bottom end of a headstone extending through the headstone aperture.

3. The stabilizing apparatus of claim 2, wherein the substantially-rigid plate has sides and a bottom so as to form a U-shaped member and at least one flexible cable attaches to the plate so that the sides of the U-shaped member extend from the bottom of the U-shaped member toward the perforated member, thereby allowing the bottom of the headstone to rest in the U-shaped member.

4. The stabilizing apparatus of claim 3, wherein two flexible cables attach to the substantially-rigid plate on respective opposite sides and to the perforated member at respective positions opposite one another across the headstone aperture.

5. The stabilizing apparatus of claim 1, wherein at least one edge of the perforated member is bent to form one said anchor.

6. The stabilizing apparatus of claim 5, wherein one said securing member comprises a securing fixture disposed along a portion of the inner periphery of the perforated member so as to extend away from the perforated material, a threaded aperture formed in the fixture, and a bolt adapted in size and with threads to match the threaded aperture so as to extend through the aperture and exert force against a lateral surface of the headstone.

7. The stabilizing apparatus of claim 1, wherein the headstone bottom support member comprises a flexible cable attached to the perforated member at respective positions opposite one another across the headstone aperture so as to enable a partial loop of the cable formed by the cable to support the bottom end of a headstone extending through the headstone aperture.

* * * * *